US009359770B1

(12) United States Patent
Bilge

(10) Patent No.: US 9,359,770 B1
(45) Date of Patent: Jun. 7, 2016

(54) SYSTEM FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 14/694,241

(22) Filed: Apr. 23, 2015

(51) Int. Cl.
*E04B 2/00* (2006.01)
*E04F 13/08* (2006.01)
*E04F 13/072* (2006.01)
*E04F 13/24* (2006.01)

(52) U.S. Cl.
CPC ..... *E04F 13/0803* (2013.01); *E04F 13/072* (2013.01); *E04F 13/24* (2013.01)

(58) Field of Classification Search
CPC ... E04F 13/0812; E04F 13/0803; E04F 13/24; E04F 13/0826; E04F 13/22; E04F 13/26; E04F 13/0816; E04B 2/721
See application file for complete search history.

(56) References Cited

U.S. PATENT DOCUMENTS 3,886,709 A * 6/1975 Krah ..... E04F 13/0803 52/396.07
5,579,624 A * 12/1996 Aeberhard ..... E04B 9/064 52/235
5,692,345 A * 12/1997 Mogaki ..... E04F 13/0812 52/34
6,988,344 B1 * 1/2006 Krueger ..... F16B 5/0635 52/464
8,127,507 B1 * 3/2012 Bilge ..... E04F 13/0814 52/235
8,739,483 B1 6/2014 Bilge
8,833,015 B2 9/2014 Bilge
8,925,271 B1 1/2015 Bilge
8,966,849 B1 3/2015 Bilge
2009/0031645 A1 * 2/2009 Smith ..... E04F 13/0803 52/127.6
2010/0263314 A1 * 10/2010 MacDonald ..... E04F 13/0826 52/506.05
2012/0096799 A1 * 4/2012 Wright ..... E04F 13/0816 52/578
2012/0240485 A1 * 9/2012 Amarasinghe ..... F24J 2/5203 52/127.1
2014/0202094 A1 * 7/2014 Bilge ..... E04F 13/0805 52/235
2014/0202112 A1 * 7/2014 Bilge ..... E04F 13/07 52/590.1
2014/0223850 A1 * 8/2014 Bilge ..... E04F 13/0858 52/506.05

* cited by examiner

*Primary Examiner* — Brian Glessner
*Assistant Examiner* — Gisele Ford
(74) *Attorney, Agent, or Firm* — Richard M. Goldberg

(57) ABSTRACT

A system for mounting wall panels to an existing wall structure, includes wall panels, each formed by a main wall panel section and at least two bent end sections; fastening extrusions, each including a base section adapted to be secured to the existing wall structure and a rigid wall extending at an angle therefrom; and a latch arrangement for securing the wall panels to the rigid wall, the latch arrangement including a latch housing, a movable latch member mounted in the latch housing for either engaging within through openings of respective ones of the rigid wall and the bent end sections, or applying a force on each bent end section positioned against a respective rigid wall, and a force application member for moving the movable latch member into a position to cause locking of respective ones of the rigid wall and the bent end sections.

16 Claims, 16 Drawing Sheets

SYSTEM FOR MOUNTING WALL PANELS TO A WALL

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes these problems is disclosed in U.S. Pat. Nos. 8,833,015, 8,739,483, 8,925,271 and 8,966,849; and pending U.S. patent application Ser. Nos. 14/044,606, 14/256,384, 14/641,097 and 14/667,297 to the same inventor herein, the entire disclosures of which are incorporated herein by reference. In these patents, each wall panel includes a main panel section and at least two bent end sections bent at a right angle in the same direction, at edges of the main panel section. Each bent end section includes a cut-out section or recess at an inner surface thereof. A fastening extrusion is secured to an existing wall for receiving the bent end sections. The fastening extrusion includes a base section and flexible and resilient bent end securing walls extending outwardly therefrom. Each bent end securing wall includes a projection on an outer surface thereof. When the bent end sections are forced in a direction toward the existing wall, the bent end sections force the respective bent end securing walls to bias away until the projections are in line with the cut-out sections or recesses, whereupon the bent end securing wall snap back to their original position in which the projections are engaged in the cut-out sections or recesses.

However, in some instances, it is necessary or desirable to manufacture the fastening extrusions from a strong, rigid metal or other material, such as aluminum, such that the bent end securing walls are not flexible and resilient. In such case, the aforementioned snap and fit assembly of the wall panels cannot be used.

It would therefore be desirable to provide a snap and fit assembly of the wall panels with rigid extrusions of the type in which the bent end securing walls are not flexible and resilient.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels are merely pressed into place and retained therein by fastening extrusions secured to the walls.

It is yet another object of the present invention to provide a wall system in which the bent end securing walls of the fastening extrusions are not flexible and resilient, but in which the wall panels are merely pressed into place and retained therein by fastening extrusions secured to the walls.

It is a further object of the present invention to provide a wall system that is easy to assemble with an existing wall structure.

It is a still further object of the present invention to provide a wall system in which the bent end securing walls of the fastening extrusions are not flexible and resilient, and in which the wall panels are held to the fastening extrusions by a spring loaded latch.

It is a yet further object of the present invention to provide a wall system that is easy and economical to manufacture and use.

In accordance with an aspect of the present invention, a system for mounting wall panels to an existing wall structure, includes a plurality of wall panels, each wall panel formed by a main wall panel section and at least two bent end sections extending at an angle from different edges of the main wall panel section, each bent end section having a wall thickness. A plurality of fastening extrusions made of a rigid material are provided, each fastening extrusion including a base section adapted to be secured to the existing wall structure and at least one first rigid wall extending at an angle from the base section. A latch arrangement is provided for securing the wall panels to the at least one first rigid wall, the latch arrangement including a latch housing. A movable latch member is mounted in the latch housing for either engaging within through openings of respective ones of the at least one first rigid wall and the bent end sections, or applying a force on each bent end section positioned against a respective first rigid wall. A force application member is provided for moving the movable latch member into a position to cause locking of respective ones of the at least one first rigid wall and the bent end sections.

In one embodiment, there are a plurality of the latch arrangements mounted to the side of each first rigid wall.

In one embodiment, each bent end section has an opening, each first rigid wall includes a through opening, and the latch arrangement is mounted to a side of each first rigid wall. In such case, the movable latch member includes a latch bolt slidably mounted in the latch housing, and the force application member includes a spring in the latch housing for biasing the latch bolt in a direction through the through opening in the first rigid wall and into the opening in a respective bent end section. The spring can be either a coil spring or a leaf spring.

Preferably, there is also a spring force adjusting arrangement for varying the force of the spring on the latch bolt. The spring force adjusting arrangement can include a screw adjustment in the latch housing for engaging the spring to adjust the force of the spring on the latch bolt.

In a modification, one end of the spring is fixed to a rear portion of the latch bolt.

Preferably, the latch bolt has a front surface that is biased into the spacing to fixedly lock said bent end section, the front surface having one of the following shapes: an inclined surface and a flat rectangular surface.

Alternatively, the latch bolt has a front surface that is biased into the spacing to releasably lock said bent end section, the front surface having one of the following shapes: a V-shaped surface and a rounded arcuate surface.

Also, preferably, each bent end section has a lower beveled surface for biasing the latch bolt in a direction into the latch housing.

In a further modification, each fastening extrusion includes a second rigid wall extending at an angle from the base section in spaced relation to the first rigid wall with a spacing therebetween, each latch housing is mounted to a side of a respective first rigid wall opposite the spacing, and the spring biases the latch bolt in a direction through the through opening in the first rigid wall and into the spacing, for engagement within the opening in a respective bent end section.

In a further modification, the latch arrangement includes a thin walled housing to which the latch housing is mounted on a side of each bent end section opposite a respective first rigid member, and the force application member moves the movable latch member into a tightening position to apply a locking force against each respect bent end section.

In one such embodiment, the latch member includes a latch bolt, and the force application member includes a coil spring to move the movable latch member into the tightening position. The force application member further includes a spring force adjusting arrangement for varying the force of the spring on the latch bolt. The spring force adjusting arrangement can include an eccentric cam for applying a force against an opposite end of the coil spring.

In another such embodiment, the latch member includes an eccentric cam, and the force application member includes a member for rotating the eccentric cam into contact with the thin walled housing.

The above and other features of the invention will become readily apparent from the following detailed description thereof which is to be read in connection with the accompanying drawings.

DETAILED DESCRIPTION

Figure 1:
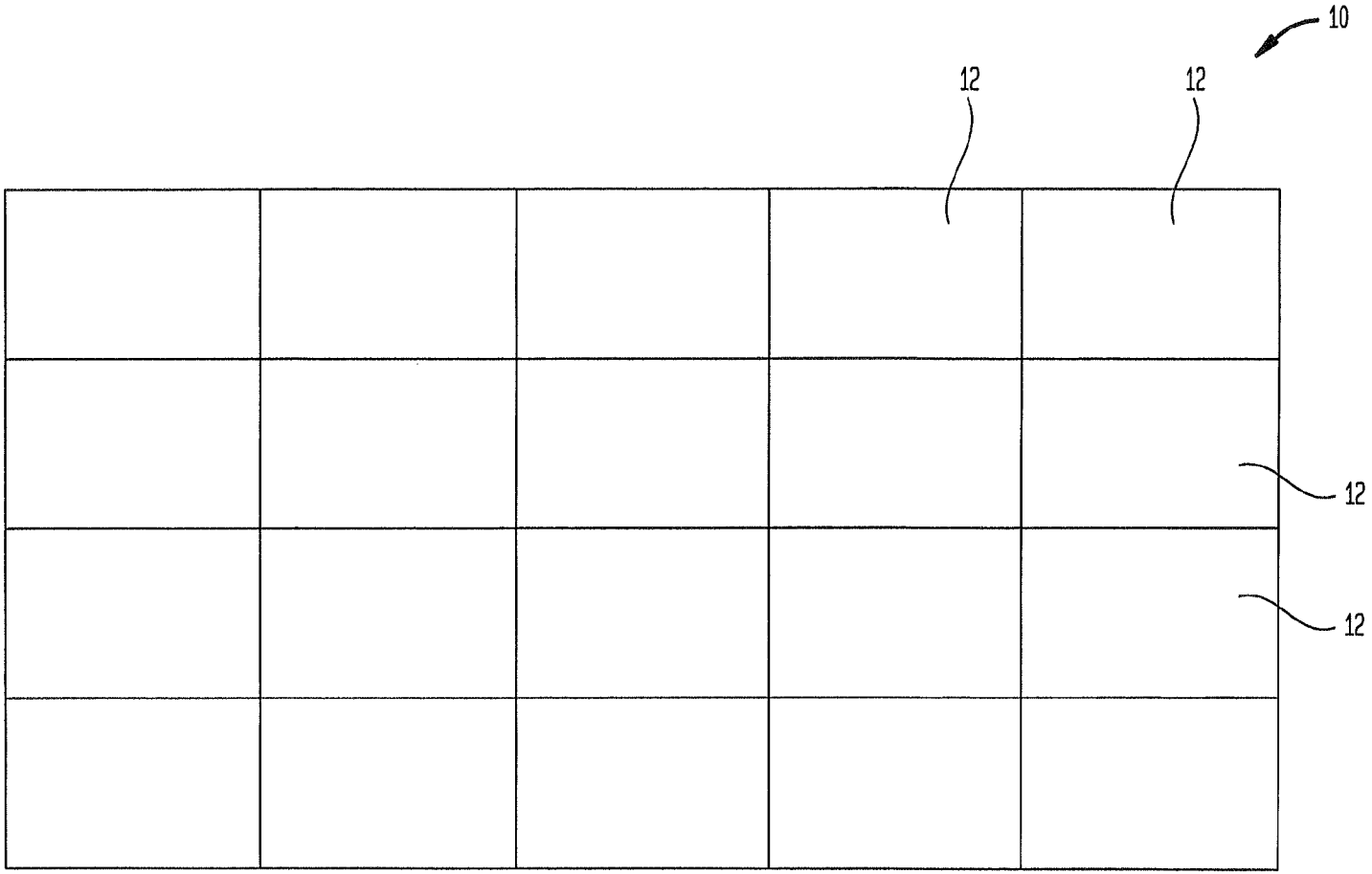
FIG. 1 is an elevational view of a plurality of wall panels mounted to an existing wall structure.
Figure 2:
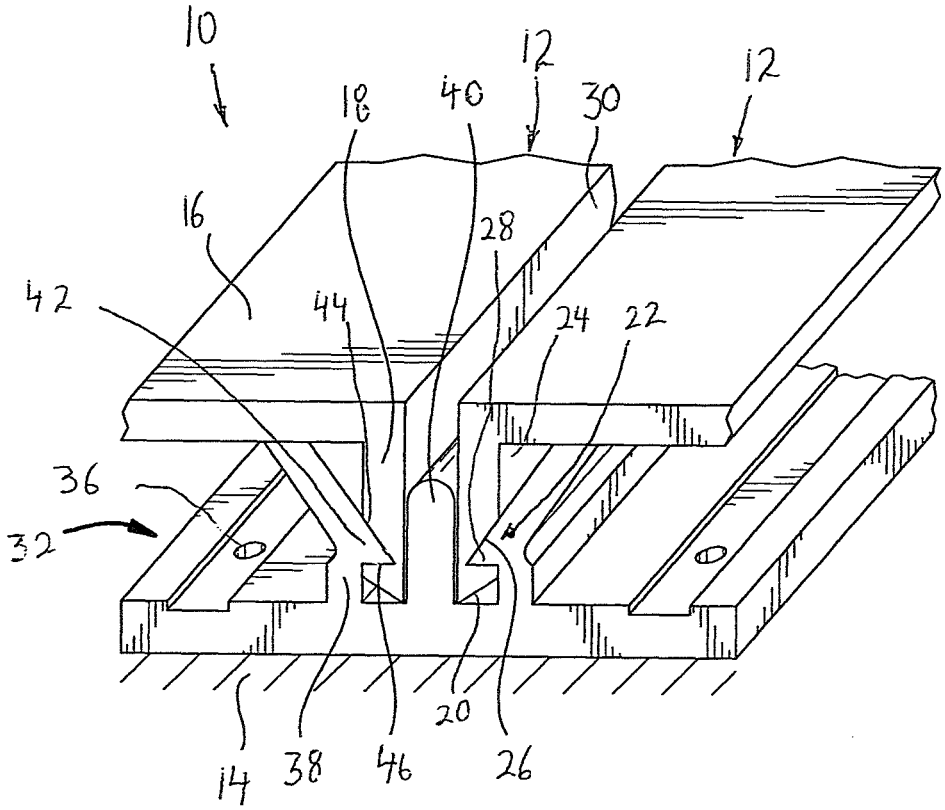
FIG. 2 is a perspective view showing two wall panels connected together by a fastening extrusion with flexible and resilient bent end securing walls.

Referring to the drawings in detail, and initially to FIGS. 1 and 2, there is shown a system 10 for easily mounting wall panels 12 over an existing wall structure 14, previously invented by the same inventor herein. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, system 10 is not limited thereby and wall panels 12 can be formed with two, three or four bent end sections 18. Wall panels 12 are formed preferably by, but not limited to, a polyethylene core with a thin aluminum wall covering opposite sides thereof. As shown in FIG. 2, each bent end section 18 is formed with a lower beveled or inclined surface 20.

In addition, each bent end section 18 includes a cut-out section or recess 22 at the inner surface 24 thereof and spaced slightly away from main panel section 16. Each cut-out section 22 preferably has a nose-shaped configuration in cross-section, although it is not limited thereby, and can have, for example, cross-sectional shapes of a square or rectangle, an arcuate shape, a V-shape or the like. For the sake of explanation, reference will be made to the nose-shaped configuration shown in FIG. 2, whereby each cut-out section 22 has an inclined surface 26 that extends toward the distal end of the bent end section 18 at the outer surface 30 thereof, and terminates at a holding surface 28 that extends parallel to main panel section 16. As a result, cut-out section 22 effectively forms a notch in the inner surface of bent end section 18. Cut-out section 22 preferably extends along the entire length of the bent end section 18, although it is not so limited, that is, cut-out section 22 can extend along only a part of the length of bent end section 18, or there may be a plurality of spaced apart cut-out sections 22.

As shown in FIG. 2, main fastening extrusions 32 are provided for securing each wall panel 12 to existing wall structure 14. Each main fastening extrusion 32 is preferably formed as a single, one-piece, unitary member that includes a base section 34 that seats flush against and is secured to existing wall structure 14. Base section 34 has a plurality of linearly aligned openings 36 extending therealong and through which screws (not shown) can be inserted to secure base section 34 to existing wall structure 14. Two, parallel, spaced apart, bent end securing walls 38 extend outwardly at right angles from base section 34 for securing bent end sections 18 of two adjacent wall panels 12 thereto. As will be understood from the discussion hereafter, bent end securing walls 38 are flexible and resilient, so that they can be bent away from each other and when the bending force is removed, return to their original positions shown in FIG. 2. In other words, although they are made of a sufficiently rigid PVC that can support heavy wall panels weighing more than 100 pounds, bent end securing walls 38 are still resilient and capable of flexing to accommodate the fitting of the wall panels therewith.

The spacing being bent end securing walls 38 is greater than the thickness of two bent end sections 18. A spacer post wall 40 extends outwardly at a right angle from base section 34 at a position between bent end securing walls 38, with the spacing between spacer post wall 40 and each bent end securing wall 38 being equal to the thickness of one bent end section 18.

Each bent end securing wall 38 includes an inwardly directed projection 42 at the inner surface of the respective bent end securing wall 38, with each projection 42 having a nose-shaped configuration in cross-section, which corresponds in shape and dimensions to nose-shaped cut-out section 22, although it is not limited thereby, and can have, for example, cross-sectional shapes of a square or rectangle, an arcuate shape, a V-shape or the like. Specifically, each projection 42 has an inclined surface 44 that slopes in a direction toward base section 34 and terminates at a holding surface 46 that extends parallel to base section 34. Projection 42 preferably extends along the entire length of the bent end securing wall 38, although it is not so limited, that is, projection 42 can extend along only a part of the length of bent end securing wall 38, or there may be a plurality of spaced apart projections 42.

With this arrangement, main fastening extrusions 32 are secured to existing wall structure 14 by screws at predetermined spacing intervals within openings 36 determined by the dimensions of wall panels 12. Thereafter, it is only necessary to push each bent end section 18 of a wall panel 12 into a respective gap between a bent end securing wall 38 and spacer post wall 40. In such case, lower beveled surface 20 of each bent end securing wall 38 first hits against inclined surface 44 and biases the respective bent end securing wall 38 outwardly away from spacer post wall 40, whereby the distal end of each bent end section 18 can pass into the space between base section 34 and inwardly directed projection 42. Once holding surface 28 passes holding surface 46, the respective bent end securing wall 38 springs back to its original position, whereby nose-shaped inwardly directed projection 42 engages in nose-shaped cut-out section 22. In such case, holding surface 46 engages holding surface 28 to prevent escape of bent end section 18.

Figure 3:
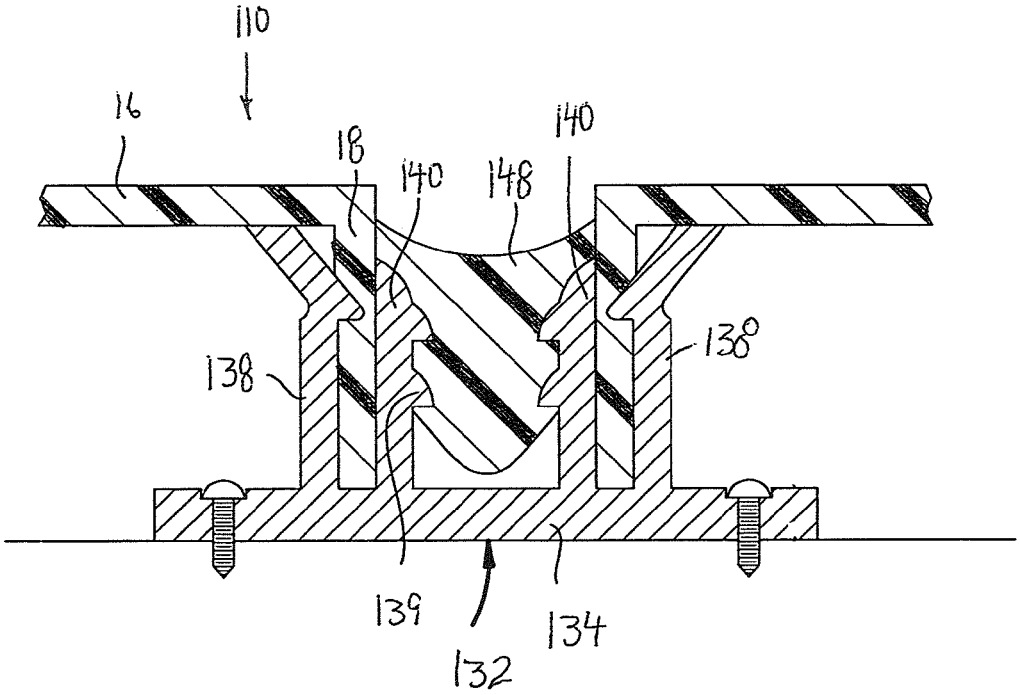
FIG. 3 is a perspective view showing two wall panels connected together by a further fastening extrusion with flexible and resilient bent end securing walls.

A modified system 110 for easily mounting wall panels 12 over an existing wall structure 14, and which was previously invented by the same inventor herein, is shown in FIG. 3, in which the elements corresponding to those in FIG. 2 are identified by the same reference numbers increased by a value of 100. The difference is that spacer post wall 40 is replaced with two parallel, spaced apart, spacer post walls 140 extending from base section 134 of each main fastening extrusion 132, with a bent end securing wall 138 mounted to the outside of each spacer post wall 140 with a spacing therebetween equal to the thickness of one bent end section 18. There are also barbs 139 on the inner surfaces of spacer post walls 140 to capture a rubber plug 148 between spacer post walls 140. Again, it is necessary that bent end securing walls 138 be flexible and resilient for securing bent end sections 18 between each bent end securing wall 138 and respective spacer post wall 140.

Figure 4:
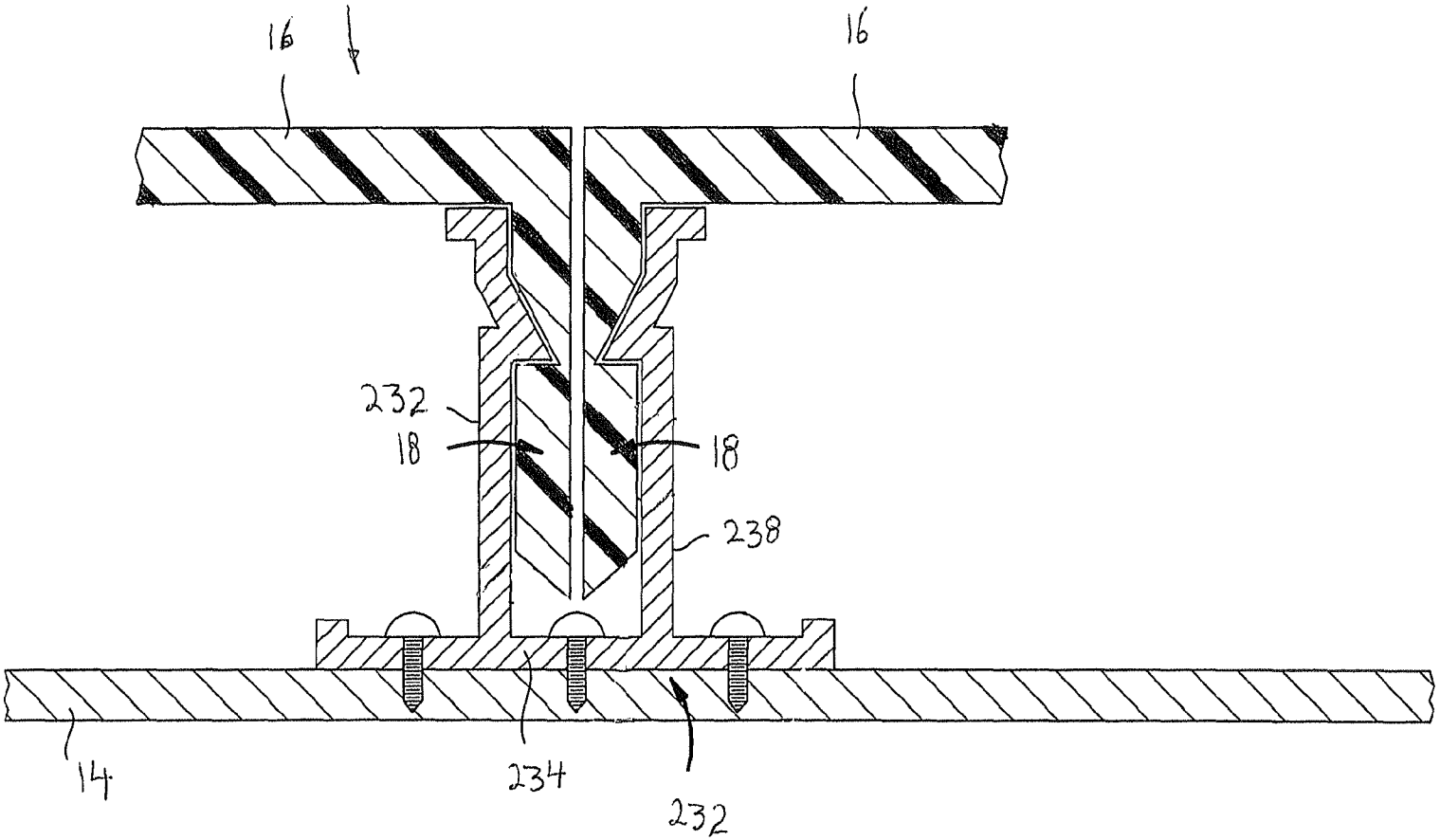
FIG. 4 is a perspective view showing two wall panels connected together by a still further fastening extrusion with flexible and resilient bent end securing walls.

A further modified system 210 for easily mounting wall panels 12 over an existing wall structure 14, and which was previously invented by the same inventor herein, is shown in FIG. 4, in which the elements corresponding to those in FIG. 2 are identified by the same reference numbers increased by a value of 200. The difference is that spacer post wall 40 is eliminated, and the spacing between bent end securing walls 238 extending from base section 234 of each main fastening extrusion 232, is equal to the thickness of two bent end sections 18. Again, it is necessary that bent end securing walls 238 be flexible and resilient for securing bent end sections 18 therebetween.

Thus, with the above known systems, it is necessary that bent end securing walls 38, 138, 238 be flexible and resilient for securing bent end sections 18 therebetween, so that they can bend away during an assembly operation.

However, in some instances, it is necessary or desirable to manufacture the fastening extrusions from a strong, rigid metal or other material, such as aluminum, such that the bent end securing walls are not flexible and resilient. In such case, the aforementioned snap and fit assembly of the wall panels cannot be used.

Figure 5:
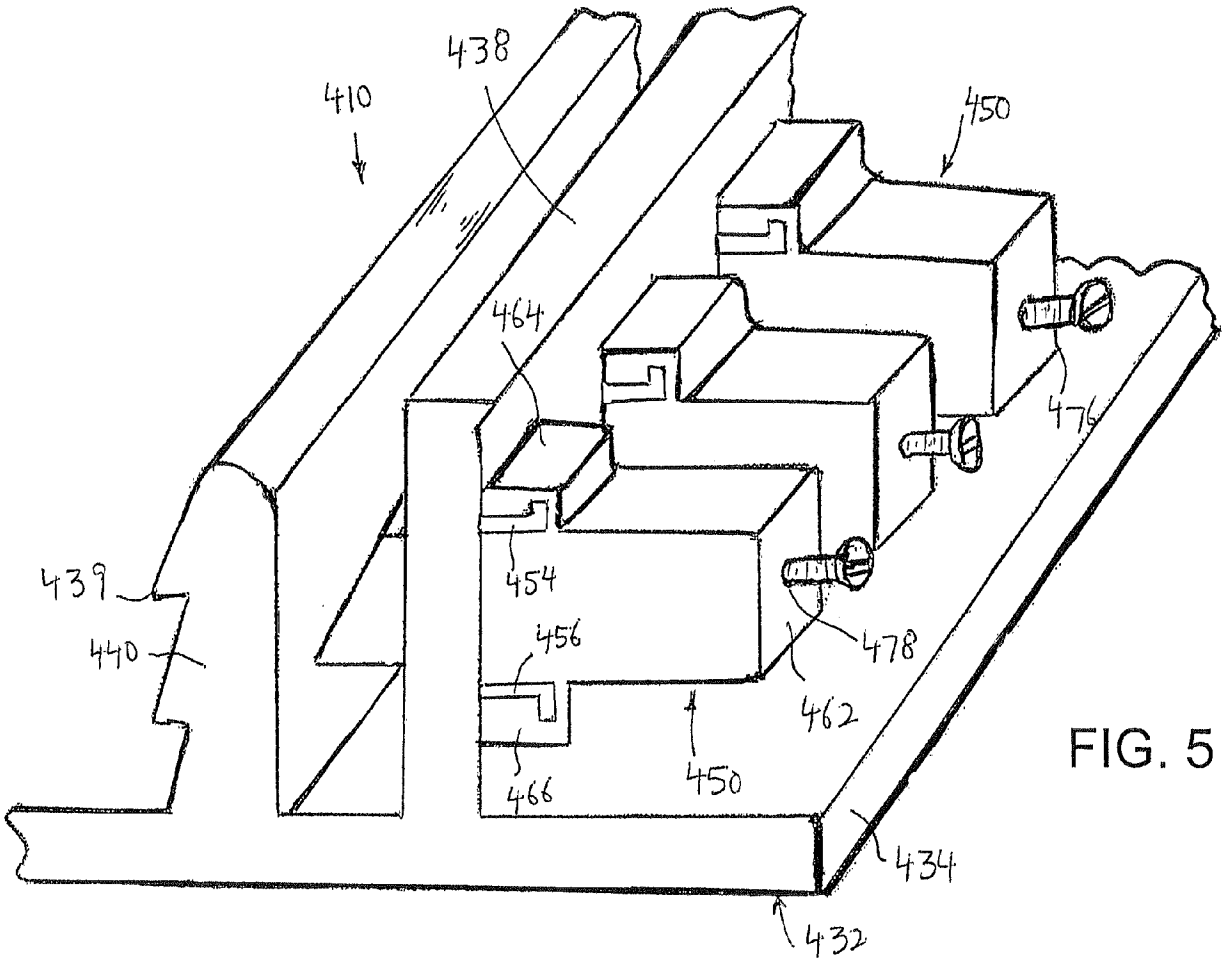
FIG. 5 is a perspective view of a system for mounting wall panels to an existing wall structure according to a first embodiment of the present invention.
Figure 6:
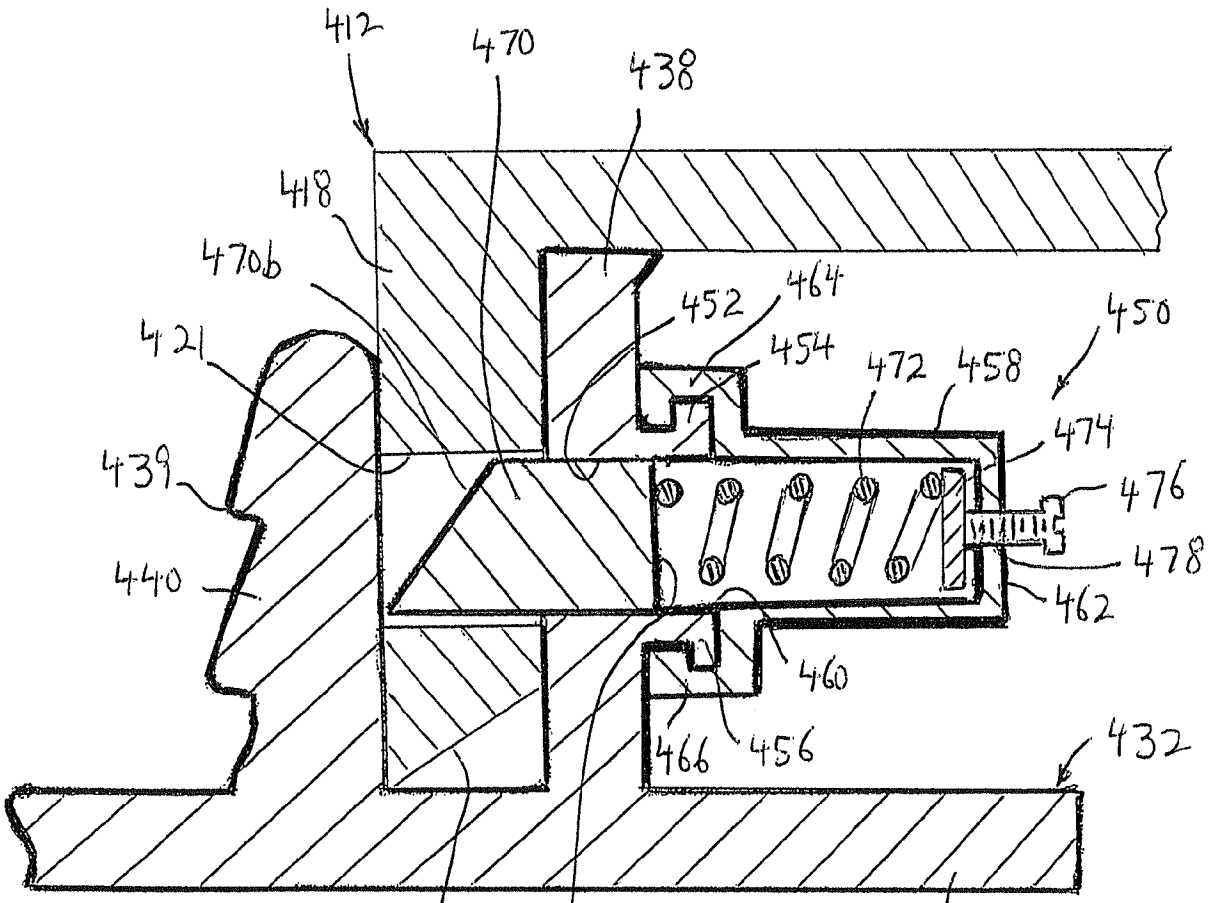
FIG. 6 is a cross-sectional view of the system of FIG. 5, taken along line 6-6 thereof, with a wall panel secured thereto.
Figure 7:
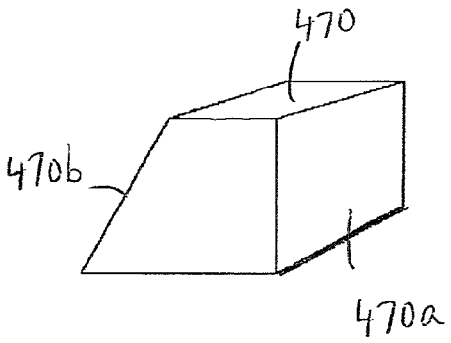
FIG. 7 is a perspective view of the latch bolt of the system of FIG. 5.

Referring now to FIGS. 5-7, a system 410 for easily mounting wall panels 12 over an existing wall structure 14 according to a first embodiment of the present invention, will now be described. System 410 is similar to system 110 of FIG. 3, although it can be used in an arrangement similar to any of the above described systems 110, 210 and 310, or any other arrangement which is disclosed in U.S. Pat. Nos. 8,833,015, 8,739,483, 8,925,271 and 8,966,849; and pending U.S. patent application Ser. Nos. 14/044,606, 14/256,384, 14/641,097 and 14/667,297 to the same inventor herein.

Specifically, as with system 110, in system 410, each bent end securing wall 438 extending from base section 434 of each main fastening extrusion 432, is mounted to the outside of a respective spacer post wall 440 with a spacing therebetween equal to the thickness of one bent end section 418. There are also barbs 439 on the inner surfaces of spacer post walls 440. However, in system 410, bent end securing walls 438 are rigid, and thereby not flexible and resilient.

Therefore, in order to secure each bent end section 418 between a respective bent end securing wall 438 and adjacent spacer post wall 440, one or more latch arrangements 450 are mounted to the outer surface of each bent end securing wall 438.

Specifically, each bent end securing wall 438 includes one or more through openings 452 therein. If there are a plurality of such through openings 452, they are preferably in alignment with each other. An upper L-shaped bracket 454 extends outwardly from the outer surface of each bent end securing wall 438 at the upper end of each opening 452, and a lower L-shaped bracket 456 extends outwardly from the outer surface of each bent end securing wall 438 at the lower end of each opening 452.

Each latch arrangement 450 includes a latch housing 458 mounted to the outer surface of each bent end securing wall 438 by upper and lower L-shaped brackets 454 and 456. Each latch housing 458 is preferably a hollow, thin-walled rigid housing having a rectangular parallelepiped configuration, with an open end 460 that abuts against the outer faces of L-shaped brackets 454 and 456 and is in open communication with the respective through opening 452, and an opposite closed end 462. However, the present invention is not limited to this shape of housing, and any other suitable shape, such as a cylindrical housing or the like can be used. An upper U-shaped bracket 464 is mounted to the open end 460 at the upper surface thereof, and a lower U-shaped bracket 466 is mounted to the open end 460 at the lower surface thereof, for sliding engagement with upper and lower L-shaped brackets 454 and 456, in order to mount each latch housing 458 to the outer surface of a respective bent end securing wall 438, such that open end 460 is in open communication with the respective through opening 452.

Figure 14:
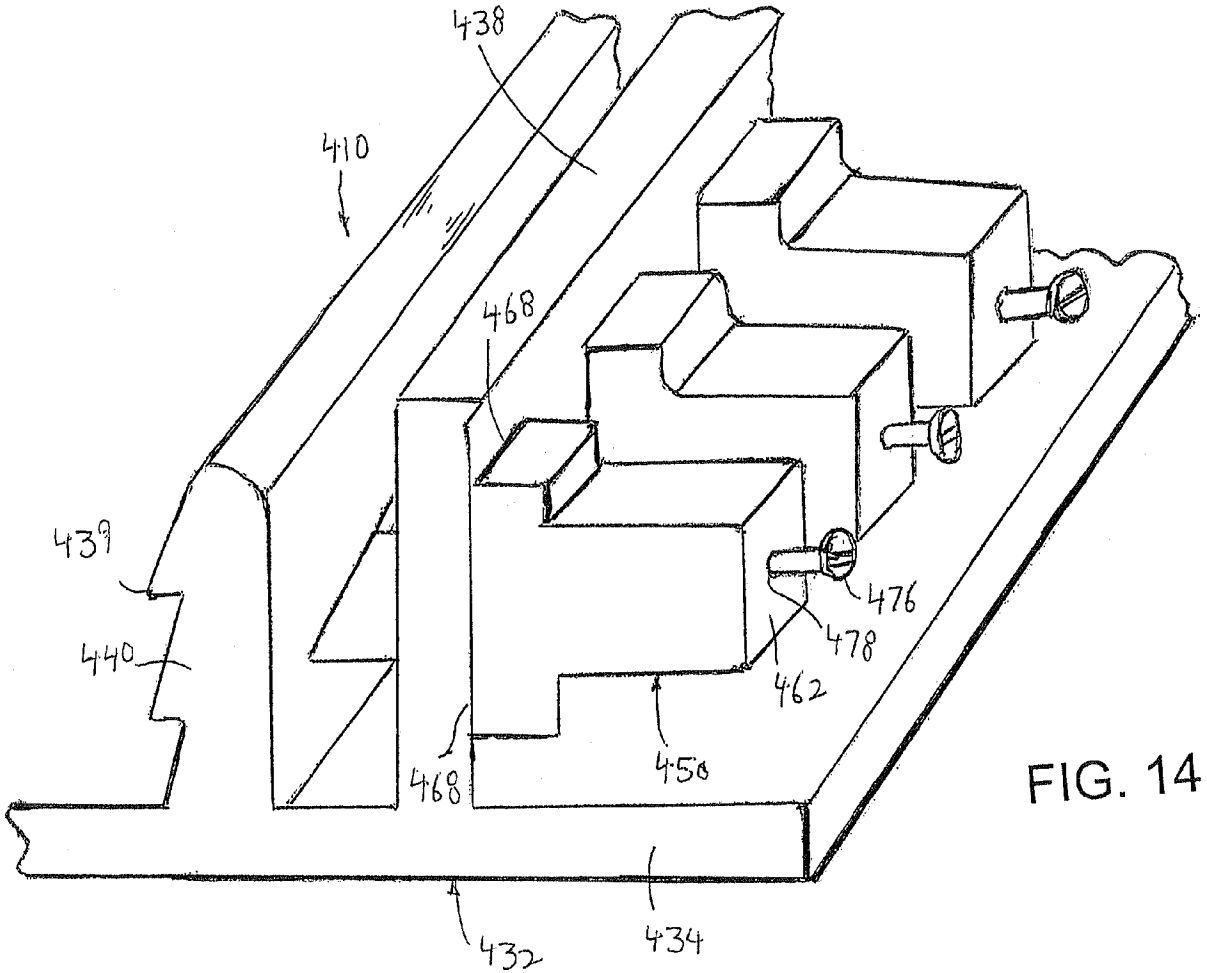
FIG. 14 is a perspective view of a system for mounting wall panels to an existing wall structure according to a modification of the first embodiment of the present invention.

It will be appreciated, however, that any other suitable means can be used to mount latch housings 458 to the outer surfaces of bent end securing walls 438. For example, as shown in FIG. 14, each latch housing 458 can be welded at 468 to the outer surfaces of bent end securing walls 438. Other securing arrangement can include adhesives, screws or bolts.

Figure 5A:
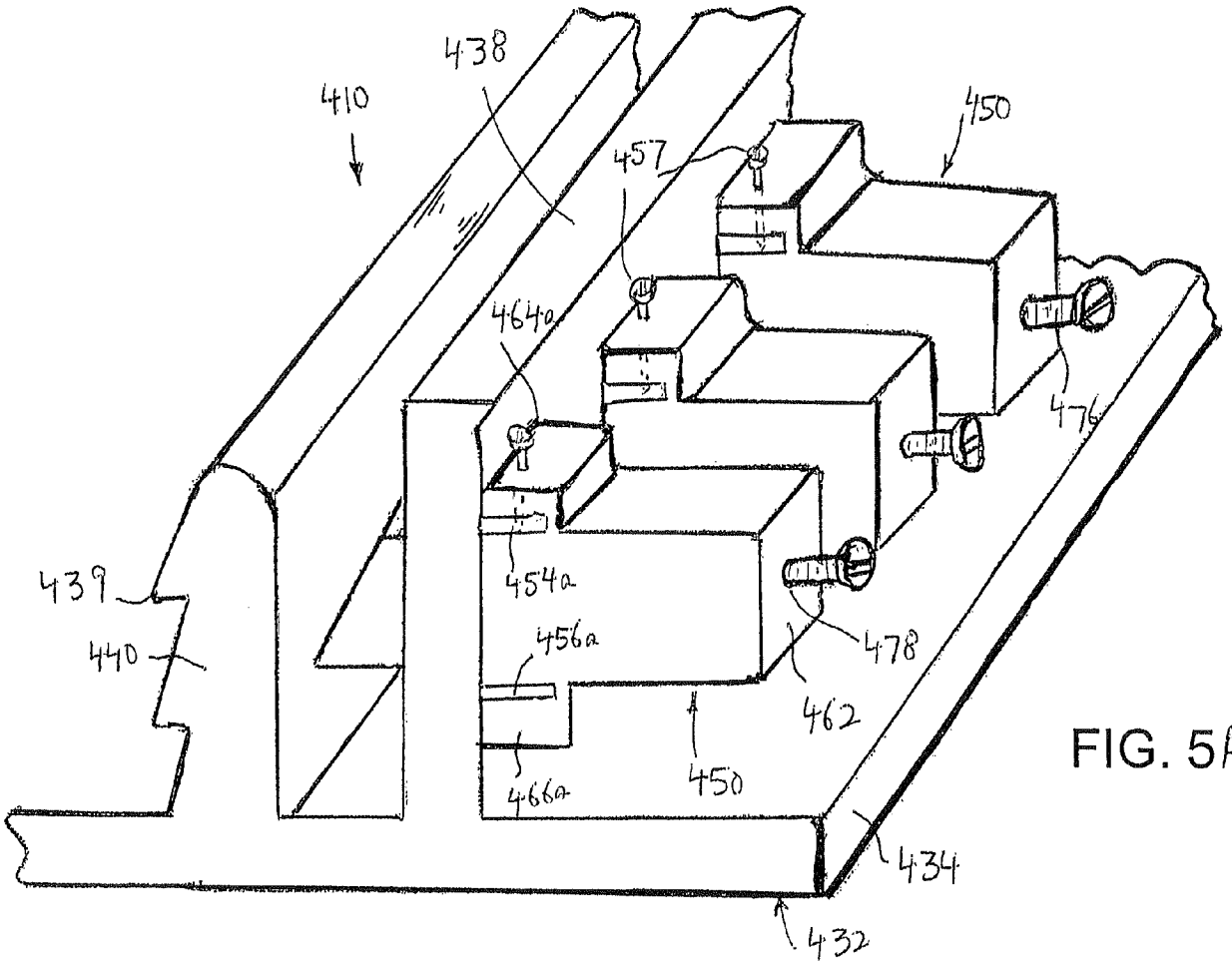
FIG. 5A is a perspective view of a system for mounting wall panels to an existing wall structure according to a modification of the first embodiment of the present invention.

Another example is shown in FIG. 5A in which L-shaped brackets 454 and 456 are replaced with planar brackets 454*a* and 456*a*, and U-shaped brackets 464 and 466 are replaced with L-shaped brackets 464*a* and 466*a* which are merely positioned over and in surrounding relation to planar brackets 454*a* and 456*a*. In this way, the housings can be inserted from the right to the left side in FIG. 5A, that is, in the lengthwise direction of the housings, rather than the side to side direction of the housings. Then, screws 457 are inserted through the upper L-shaped brackets 464*a* into the upper planar brackets 454*a* to secure the housings to bent end securing walls 438.

A latch bolt 470 is slidably received within latch housing 458, and is adapted to extend through the respective opening 452. As shown in FIGS. 6 and 7, each latch bolt 470 preferably has the shape of a right trapezoid in cross-section, with a rear surface 470*a* that is at right angles with the upper and lower surfaces and a front inclined wedge surface 470*b* that inclines outwardly from the upper surface to the lower surface. A coil spring 472 mounted inside housing 458 has one end in abutting relation to rear surface 470*a* and the opposite end in contact with closed end 462 in order to bias latch bolt 470 through the respective opening 452 into the gap between the respective bent end securing wall 438 and adjacent spacer post wall 440, with inclined wedge surface 470*b* facing away from base section 434.

Alternatively, in order to adjust the force of coil spring 472, a slidable plate 474 can be positioned between the opposite end of coil spring 472 and closed end 462. A screw 476 is threadedly received in a threaded opening 478 in closed end 462 for engagement with slidable plate 474 in order to compress coil spring 472 in order to adjust the force thereof on latch bolt 470.

Each bent end section 418 includes, in addition to a lower beveled surface 420, one or more through openings 421 which are in alignment with through openings 452 when assembled with main fastening extrusions 438. Alternatively, openings 421 need only extend partially through each bent end section 418 so as to effectively form a recess. However, reference hereinafter to any openings in bent end sections 418 will mean either through openings or recesses.

In order to assemble wall panels 412 with main fastening extrusions 438, it is only necessary to push each bent end section 418 of wall panels 412 into a respective gap between a bent end securing wall 438 and spacer post wall 440. In such case, lower beveled surface 420 of each bent end securing wall 438 first hits against inclined wedge surface 470*b* to move latch bolt 470 in a direction away from spacer post wall 440 and into latch housing 458 against the force of coil spring 472. Once the lower surface defining through opening 421 passes the lower surface of latch bolt 470, coil spring 472 biases latch bolt 470 to the left in FIG. 6 into through opening 421, to prevent escape of bent end section 418, and thereby hold wall panel 412 to main fastening extrusion 438. Of course, where there are a plurality of latch arrangements 450 mounted to a single bent end securing wall 438, they all operate in synchronism to lock the bent end section 418 to the main fastening extrusion 438.

Figure 8:
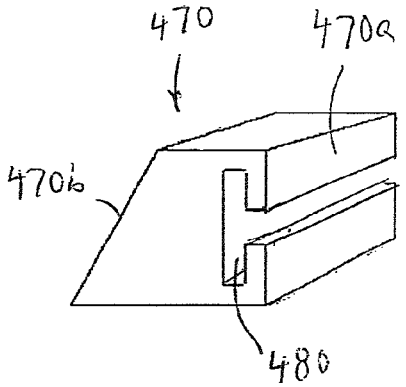
FIG. 8 is a perspective view of a first modified latch bolt for use in the system of FIG. 5.
Figure 9:
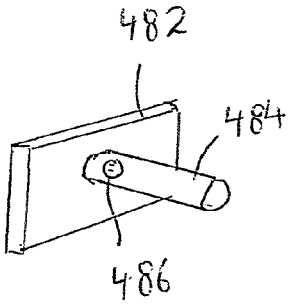
FIG. 9 is a perspective view of the latch bolt engagement member for use with the first modified latch bolt of FIG. 8.
Figure 10:
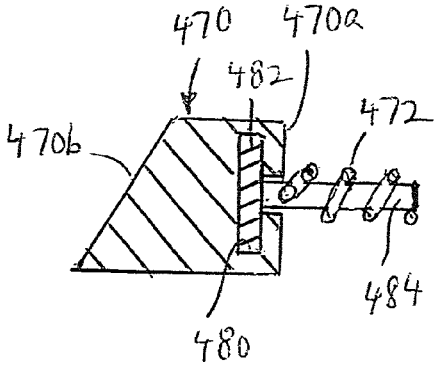
FIG. 10 is a cross-sectional view of the latch bolt and latch bolt engagement member of FIGS. 8 and 9, along with the coil spring associated therewith.

It will be appreciated that, while coil spring 472 in FIG. 6 merely abuts against rear surface 470*a* of latch bolt 470, one end of coil spring 472 can effectively be secured to latch bolt 470 for easier assembly. As one example, as shown in FIGS. 8-10, a T-shaped opening 480 in cross-section is provided in rear surface 470*a* of latch bolt 470. A plate 482 is inserted into T-shaped opening 480 and has a cylindrical stud 484 that extends out of T-shaped opening 480 in a direction toward closed end 462. Stud 484 has an opening 486 therein adjacent the end thereof that is mounted to plate 482 for receiving one end of coil spring 472, thereby securing coil spring 472 to latch bolt 470. Alternatively, stud 484 can be secured directly to the rear surface 470*a* of latch bolt 470, thereby eliminating T-shaped opening 480 and plate 482.

Figure 11:
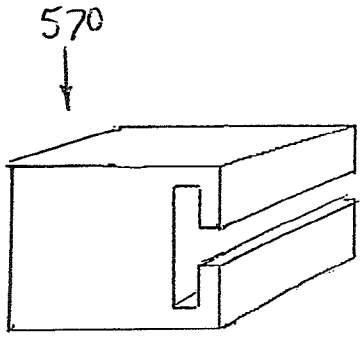
FIG. 11 is a perspective view of a second modified latch bolt engagement member for use in the system of FIG. 5.

It will be appreciated that, although latch bolt 470 has been described as having a right trapezoid shape in cross-section, the present invention is not limited thereby. For example, a latch bolt 570, as shown in FIG. 11, can have a rectangular parallelepiped shape to lock each bent end section 418 to a main fastening extrusion 432.

Figure 12:
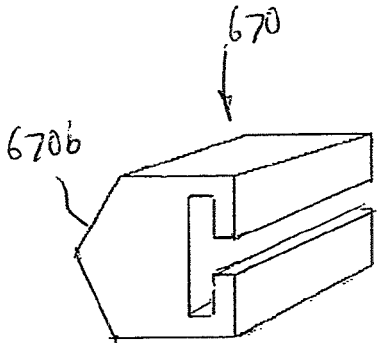
FIG. 12 is a perspective view of a third modified latch bolt engagement member for use in the system of FIG. 5.
Figure 13:
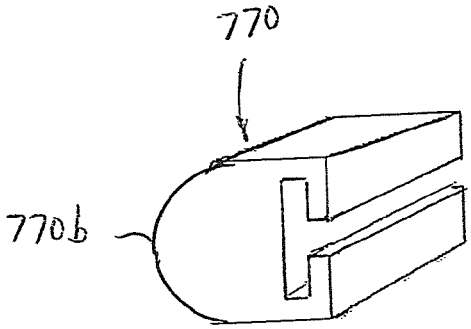
FIG. 13 is a perspective view of a fourth modified latch bolt engagement member for use in the system of FIG. 5.

Still further, in order to enable removal and replacement of wall panels 412, as shown by latch bolts 670 and 770 in FIGS. 12 and 13, the front inclined wedge surface can be replaced with a front V-shaped wedge surface 670*b* or a front arcuate wedge surface 770*b*, respectively. Upon application of a suitable pulling out force on wall panels 412, a reverse wedging operation occurs which forces latch bolts 670 and 770 inwardly of the latch housing against the force of the coil spring 472 to remove bent end sections 418.

Figure 15:
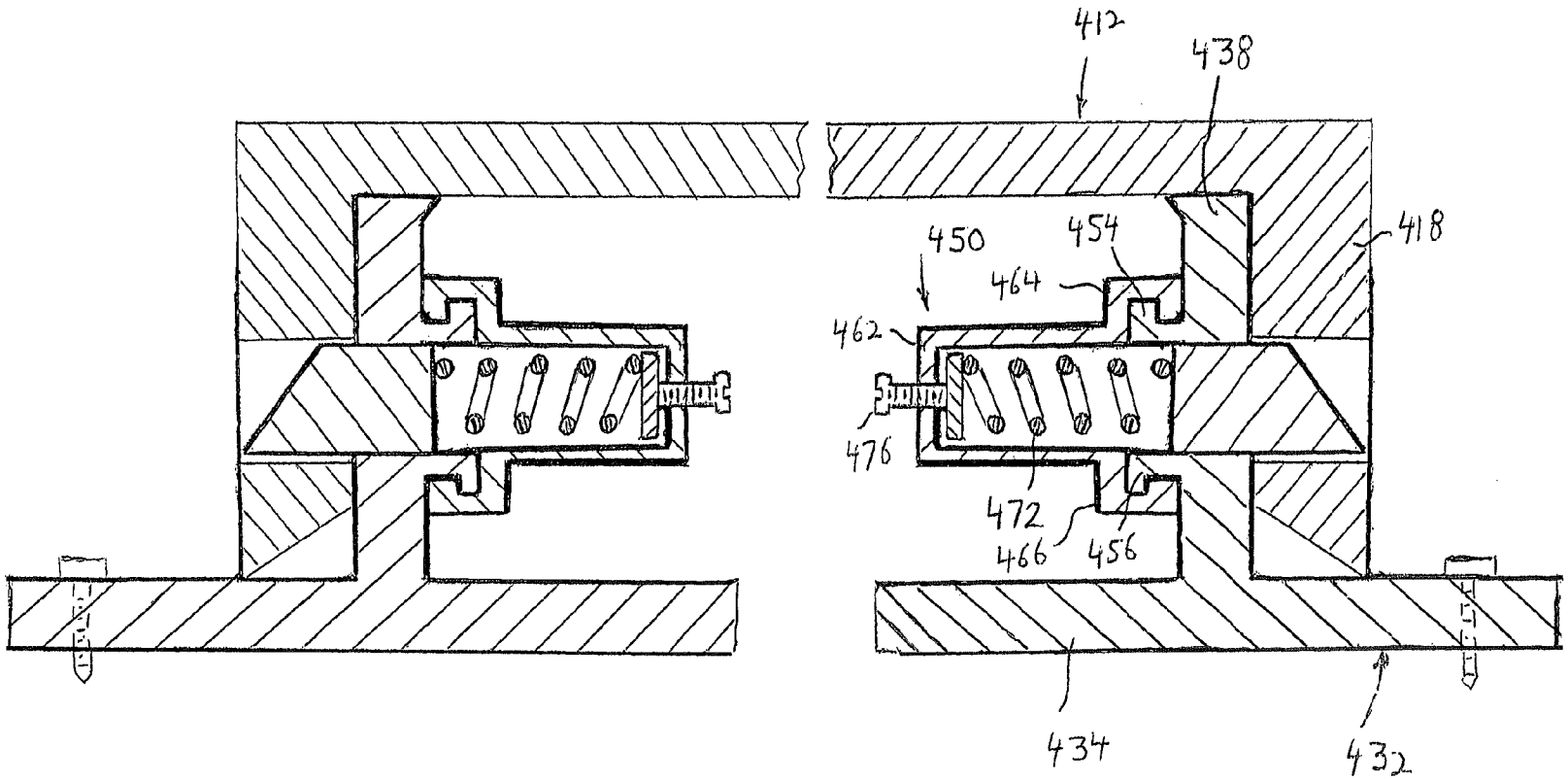
FIG. 15 is a perspective view of a system for mounting wall panels to an existing wall structure according to a further modification of the first embodiment of the present invention.

Referring now to FIG. 15, there is shown a modification of the present invention of FIGS. 5-7 in which spacer post walls 440 are eliminated. In this case, bent end sections 418 of wall panels 412 are merely positioned around bent end securing walls 438 and secured thereat by latch assemblies 450.

Figure 16:
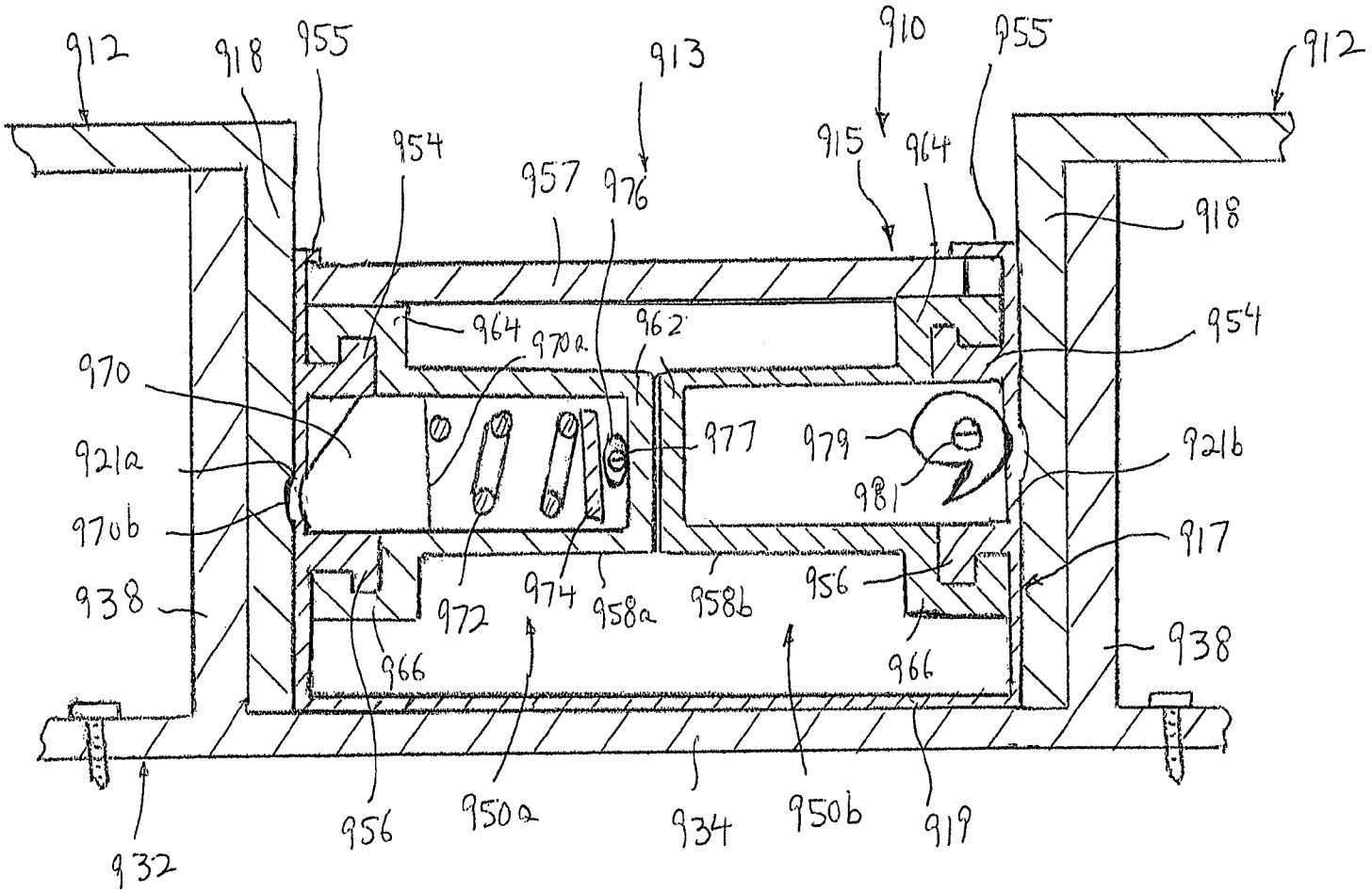
FIG. 16 is a perspective view of a system for mounting wall panels to an existing wall structure according to a still further modification of the first embodiment of the present invention.

Referring now to FIG. 16, there is shown a system 910 which is a modification of the present invention of FIG. 15. With system 910, the latch assemblies are positioned in the space between adjacent wall panels 910, rather than being positioned beneath the wall panels 910. Thus, bent end sections 918 of wall panels 912 are positioned around bent end securing walls 938, with a gap 913 between bent end securing walls 938 of adjacent wall panels 912. Then, a gap closing assembly 915 of two latch arrangements 950*a* and 950*b* is inserted into gap 913 to close off gap 913 and to secure bent end sections 918 in position.

Specifically, gap closing assembly 915 includes a thin walled housing 917 formed by a bottom wall 919 that seats against base section 934 of main fastening extrusion 932, and two side walls 921*a* and 921*b* that fit flush against the exposed sides of bent end sections 918 of wall panels 912 which are positioned around bent end securing walls 938, in order to close off the gap 913. Each side wall 921*a* and 921*b* includes an upper L-shaped bracket 954 and a lower L-shaped bracket 956 to receive U-shaped brackets 964 and 966 of latch housings 958*a* and 958*b* of latch arrangements 950*a* and 950*b* in the same manner as previously described. However, in this case, closed ends 962 of latch housings 958*a* and 958*b* are immediately adjacent each other. A further upper L-shaped bracket 955 is positioned above each upper U-shaped bracket 964, in order to receive a closure plate 957 captured between upper U-shaped bracket 964 and further upper L-shaped bracket 955, to close off gap 913 and provide an aesthetically pleasing appearance to the wall. It is noted that L-shaped bracket 955 at the right side of FIG. 16 is a little longer than the L-shaped bracket 955 at the left side of FIG. 16 and that closure plate 957 is slightly smaller in the widthwise dimension than the distance between side walls 921*a* and 921*b*. In this regard, to insert closure plate 957, closure plate is angled slightly so that the right side of closure plate 957 is first inserted beneath the longer L-shaped bracket 955 at the right side of FIG. 16, whereupon the left side of closure plate 957 clears the edge of the shorter L-shaped bracket 955 at the left side of FIG. 16. Then, closure plate 957 is slid to the left in FIG. 16 until the left edge abuts against side wall 921*a*. In this position, both sides of closure plate 957 are captured by L-shaped brackets 955 on both sides.

Although latch arrangements 950*a* and 950*b* can be of the same type described above with respect to FIGS. 5-14, modifications of these latch assemblies are shown.

Specifically, latch arrangement 950*a* is identical to latch arrangement 450 of FIG. 6, except that, in place of adjustment screw 476, an eccentric cam 976 is placed in latch housing 958*a* between closed end 962 and slidable plate 974, and has a turn screw 977 fixed to cam 976, with turn screw 977 threadedly engaged within a side wall of latch housing 958*a*. Thus, as screw 977 is rotated, eccentric cam 976 applies a force on slidable plate 974 to adjust the tension on coil spring 972. Coil spring 972 applies pressure on rear surface 970*a* of latch bolt 970, with the opposite front surface 970*b* of latch bolt 970 applying a force on side wall 921*a* of thin walled housing 917 that slightly deforms side wall 921*a* and the respective bent end section 918, thereby applying a holding force on the respective bent end section 918 to retain it in place.

Latch arrangement 950*b* operates in a similar manner to latch arrangement 950*a*. However, latch bolt 970, coil spring 972, plate 974 and eccentric cam 976 are eliminated. Rather, in place thereof, an eccentric cam 979 is placed in latch housing 958*b* adjacent side wall 921*b*, and has a turn screw 981 fixed to eccentric cam 979, with turn screw 981 threadedly engaged within a side wall of latch housing 958*b*. Thus, as screw 981 is rotated, eccentric cam 979 directly applies a tightening force on side wall 921*b* that slightly deforms side wall 921*b* and the respective bent end section, thereby applying a holding force on the respective bent end section 918 to retain it in place.

Figure 16A:
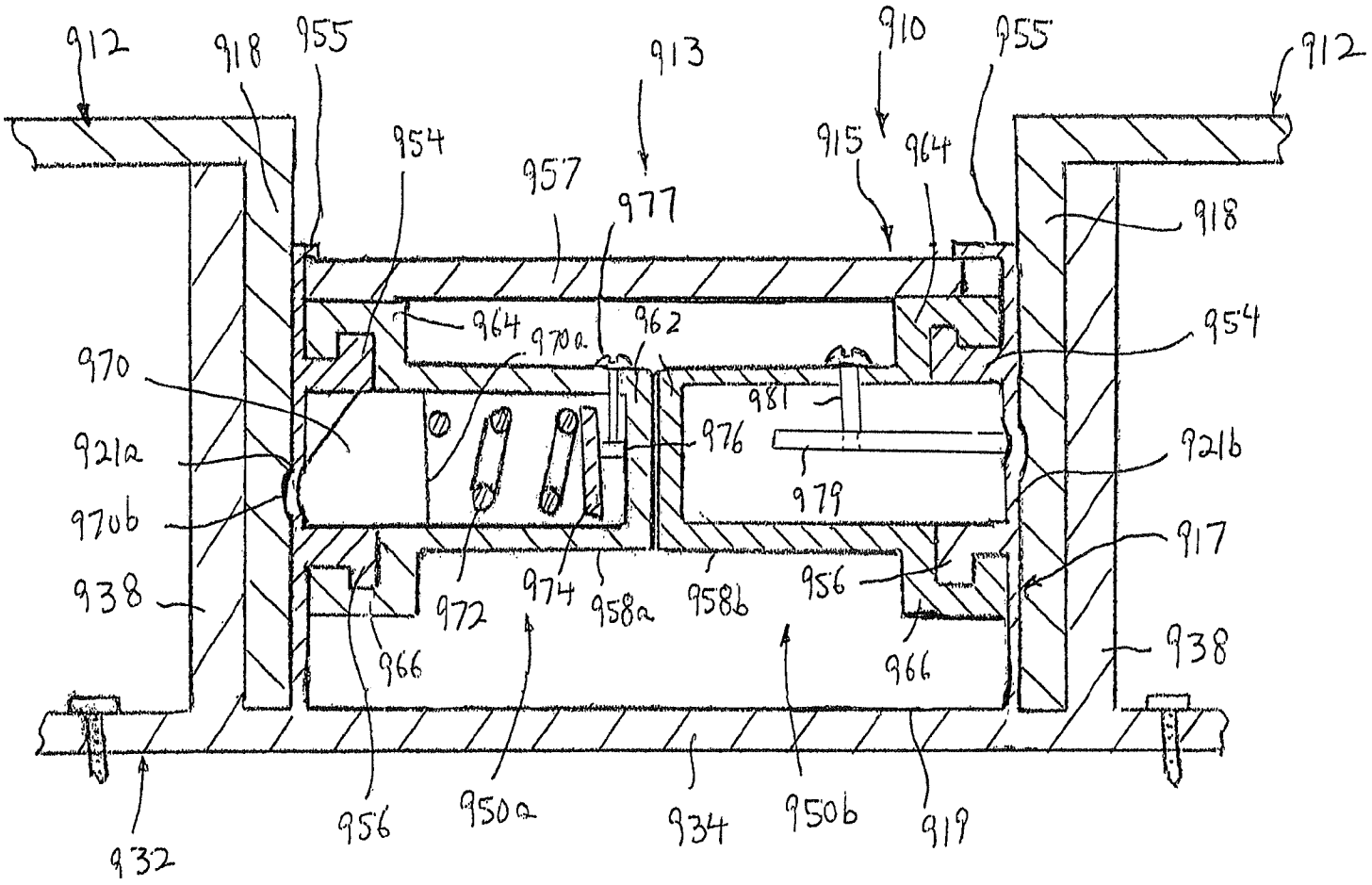
FIG. 16A is a perspective view of a system for mounting wall panels to an existing wall structure according to a yet further modification of the first embodiment of the present invention.

Referring to FIG. 16A, there is shown a modification of the system 910 of FIG. 16. Specifically, thin walled housing 917 is formed integrally as one-piece with main fastening extrusion 932, with the lower ends of side walls 921*a* and 921*b* formed integrally as one-piece with base section 934. With such arrangement, bent end sections 918 are positioned between side walls 921*a* and 921*b* and their respective bent end securing wall 938. Then, latch arrangements 950*a* and 950*b* are slid into position from a side to the position shown in FIG. 16A.

In addition, eccentric cams 976 and 979 are oriented 90 degrees from the orientation shown in FIG. 16 so that they are rotatable in a horizontal plane of FIG. 16A. As a result, turn screws 977 and 981 threadedly extend through the uppermost wall portion in FIG. 16A and are fixed to the respective eccentric cams 976 and 979. In this manner, when a person, using a screwdriver inserted into the slot in the head of the respective turn screw 977 or 981, rotates rotating eccentric cams 976 and 979.

With this latter arrangement, after turn screws 977 and 981 have been rotated to their desired tightening/holding positions, closure plate 957 is then inserted from the side.

Figure 17:
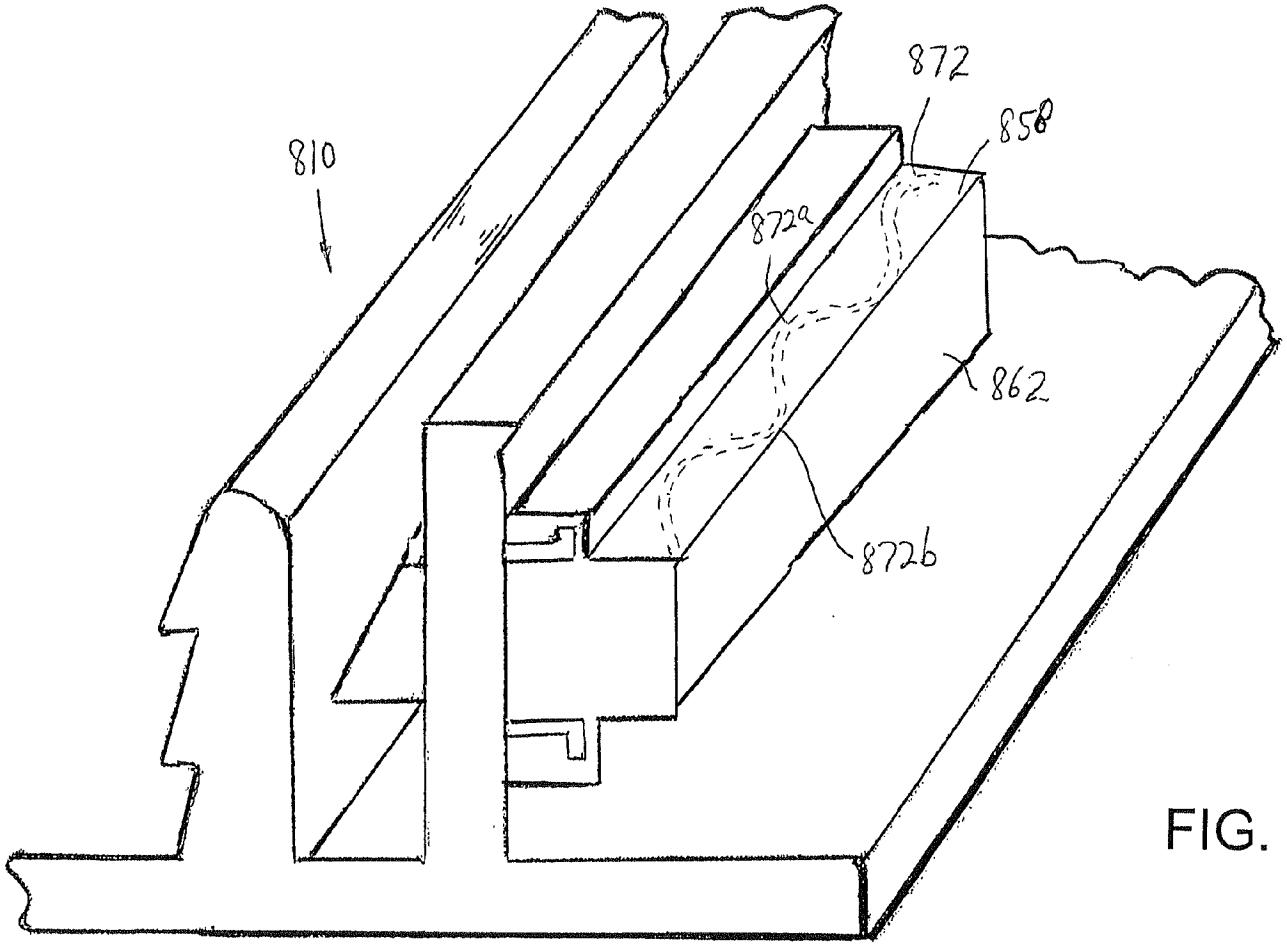
FIG. 17 is a perspective view of a system for mounting wall panels to an existing wall structure according to a second embodiment of the present invention.
Figure 18:
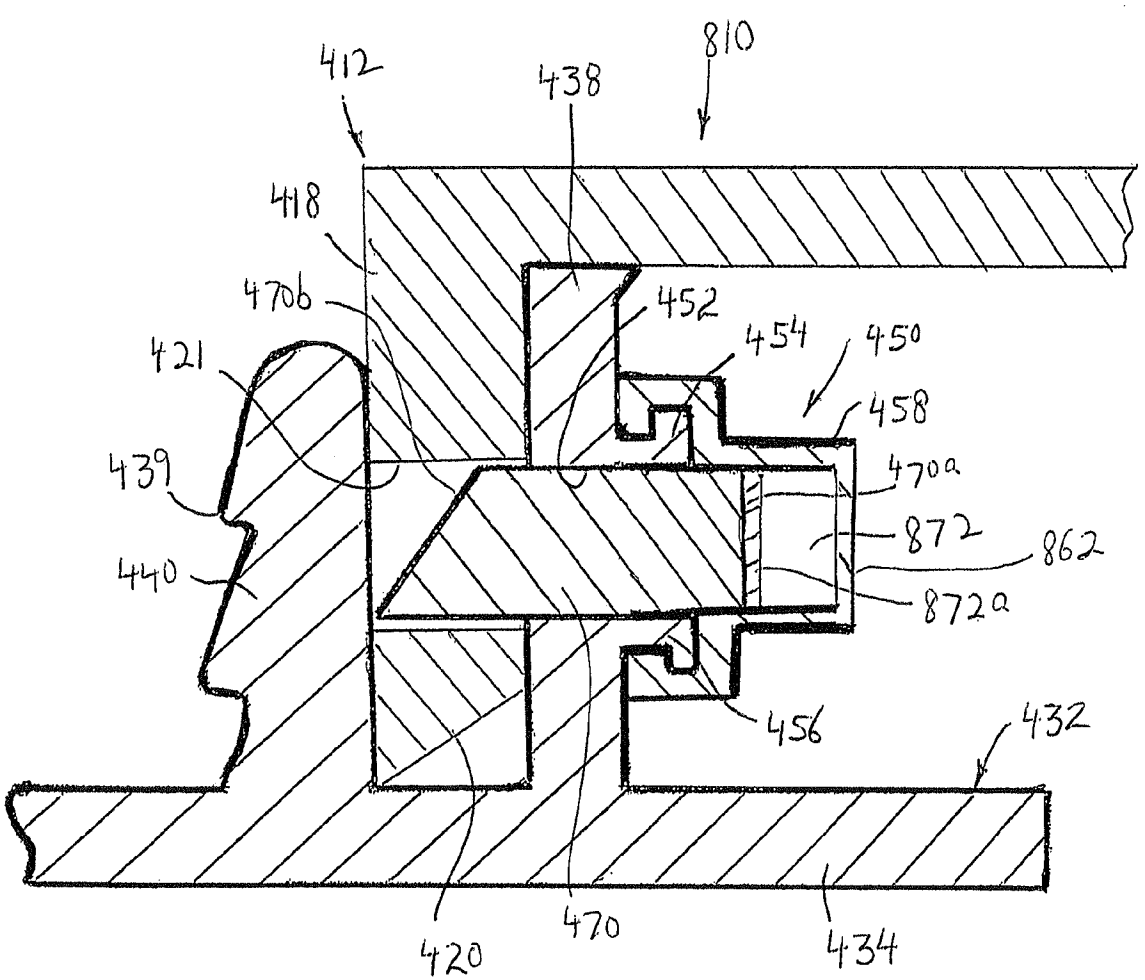
FIG. 18 is a cross-sectional view of the system of FIG. 15, taken along line 16-16 thereof, with a wall panel secured thereto.
Figure 19:
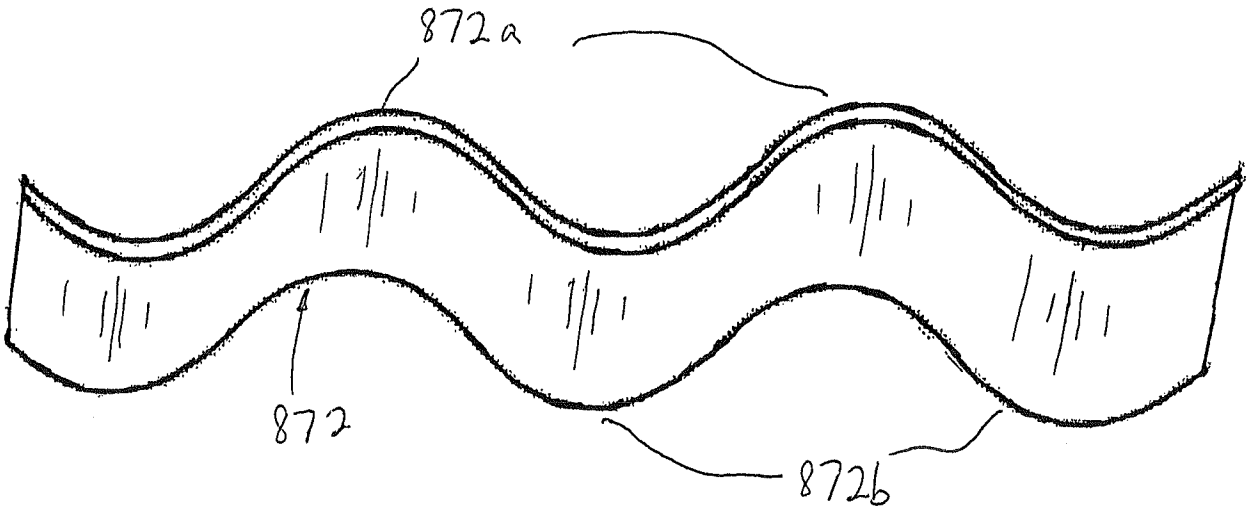
FIG. 19 is a perspective view of the wave leaf spring used with the system of FIG. 15.

Referring now to FIGS. 17-19, a system 810 for easily mounting wall panels 12 over an existing wall structure 14 according to a second embodiment of the present invention, will now be described.

With system 810, rather than providing a plurality of discrete latch housings, a single elongated latch housing 858 is provided. There are still a plurality of latch bolts 470 therein for insertion in through openings 452 in each bent end section 418 of each wall panel 412. In order to bias latch bolts 470 into the gap between bent end securing wall 438 and spacer post wall 440, a single sinusoidal shaped wave leaf spring 872 is provided between rear surfaces 470*a* thereof and closed end 862 of latch housing 858, with the peaks 872*a* on one side in contact with rear surfaces 470*a* of latch bolts 470, and the peaks 872*b* on the other side in contact with closed end 862 of latch housing 858, in order to provide a biasing force on latch bolts 470. Of course, a single elongated latch bolt 470 can be provided in place of a plurality of latch bolts 470.

Further, a plurality of screws 476 can be threadedly received in threaded openings 478 in closed end 862 for engagement with peaks 872*b* in order to compress coil spring 872 in order to increase the force thereof on latch bolts 470.

It will be appreciated that, while the wall panels above have been shown to have planar main panel sections and perpendicular bent end sections, the present invention is not limited thereby. Thus, bent end sections can extend down from the planar main panel sections at an angle other than a right angle. Further, main panel sections can have a three-dimensional shape, for example, as described in applicant's copending U.S. patent application Ser. Nos. 14/641,097, 29/520,340, 29/520,342, 29/520,345, 29/520,347, 29/520,350, 29/520,351 and 29/520,354, the entire disclosures of which are incorporated herein by reference.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel formed by a main wall panel section and at least two bent end sections extending at an angle from different edges of said main wall panel section, each bent end section having a wall thickness, an inner surface and an outer surface, a plurality of fastening extrusions made of a rigid material, each fastening extrusion including a base section adapted to be secured to the existing wall structure and at least one first rigid wall extending at an angle from said base section, with said inner surface of each bent end section facing a respective said first rigid wall, a latch arrangement for securing said wall panels to said at least one rigid wall, said latch arrangement including:

a latch housing, a movable latch member mounted in said latch housing adjacent one of said inner surface and outer surface of a respective said bent end section for one of:

engaging within through openings of respective ones of said at least one first rigid wall and said bent end sections, and applying a force on each bent end section positioned against a respective first rigid wall, and a force application member positioned adjacent a same one of said one of said inner surface and outer surface as said movable latch member and being disconnected from the first rigid wall for moving said movable latch member into a position to cause locking of respective ones of said at least one first rigid wall and said bent end sections.

2. A system according to claim 1, wherein there are a plurality of said latch arrangements mounted to a side of each said first rigid wall.

3. A system for mounting wall panels to an existing wall structure, comprising:

a plurality of wall panels, each wall panel formed by a main wall panel section and at least two bent end sections extending at an angle from different edges of said main wall panel section, each bent end section having a wall thickness, a plurality of fastening extrusions made of a rigid material, each fastening extrusion including a base section adapted to be secured to the existing wall structure and at least one first rigid wall extending at an angle from said base section, a latch arrangement for securing said wall panels to said at least one rigid wall, said latch arrangement including:

a latch housing, a movable latch member mounted in said latch housing for one of:

engaging within through openings of respective ones of said at least one first rigid wall and said bent end sections, and applying a force on each bent end section positioned against a respective first rigid wall, and a force application member for moving said movable latch member into a position to cause locking of respective ones of said at least one first rigid wall and said bent end sections;

wherein:

each bent end section has an opening, each first rigid wall includes a through opening, and said latch arrangement is mounted to a side of each said first rigid wall, said movable latch member includes a latch bolt slidably mounted in said latch housing, and said force application member includes a spring in said latch housing for biasing said latch bolt in a direction through said through opening in said first rigid wall and into said opening in a respective said bent end section.

4. A system according to claim 3, wherein said spring is one of:

a coil spring, and a leaf spring.

5. A system according to claim 3, further comprising a spring force adjusting arrangement for varying a force of the spring on the latch bolt.

6. A system according to claim 5, wherein the spring force adjusting arrangement includes a screw adjustment in said latch housing for engaging said spring to adjust the force of said spring on the latch bolt.

7. A system according to claim 3, wherein one end of the spring is fixed to a rear portion of said latch bolt.

8. A system according to claim 3, wherein said latch bolt has a front surface that is biased into said opening in a respective said bent end section to fixedly lock said bent end section, said front surface having one of the following shapes:

an inclined surface, and a flat rectangular surface.

9. A system according to claim 3, wherein said latch bolt has a front surface that is biased into said opening in a respective said bent end section to releasably lock said bent end section, said front surface having one of the following shapes:

a V-shaped surface, and a rounded arcuate surface.

10. A system according to claim 3, wherein each bent end section has a lower beveled surface for biasing said latch bolt in a direction into said latch housing.

11. A system according to claim 3, wherein:

each fastening extrusion includes a second rigid wall extending at an angle from said base section in spaced relation to the first rigid wall with a spacing therebetween, each latch housing is mounted to a side of a respective said first rigid wall opposite said spacing, and said spring biases said latch bolt in a direction through said through opening in said first rigid wall and into said spacing, for engagement within the opening in a respective said bent end section.

12. A system for mounting wall panels to an existing wall structure, comprising:

a plurality of wall panels, each wall panel formed by a main wall panel section and at least two bent end sections extending at an angle from different edges of said main wall panel section, each bent end section having a wall thickness, a plurality of fastening extrusions made of a rigid material, each fastening extrusion including a base section adapted to be secured to the existing wall structure and at least one first rigid wall extending at an angle from said base section, a latch arrangement for securing said wall panels to said at least one rigid wall, said latch arrangement including:

a latch housing, a movable latch member mounted in said latch housing for one of:

engaging within through openings of respective ones of said at least one first rigid wall and said bent end sections, and applying a force on each bent end section positioned against a respective first rigid wall, and a force application member for moving said movable latch member into a position to cause locking of respective ones of said at least one first rigid wall and said bent end sections;

wherein:

the latch arrangement includes a thin walled housing to which said latch housing is mounted on a side of each bent end section opposite a respective said first rigid member, and the force application member moves said movable latch member into a tightening position to apply a locking force against each respect bent end section.

13. A system according to claim 12, wherein:

said latch member includes a latch bolt, and said force application member includes a coil spring to move said movable latch member into said tightening position.

14. A system according to claim 13, wherein said force application member includes a spring force adjusting arrangement for varying the force of the spring on the latch bolt.

15. A system according to claim 14, wherein said spring force adjusting arrangement includes an eccentric cam for applying a force against an opposite end of said coil spring.

16. A system according to claim 12, wherein:

said latch member includes an eccentric cam, and said force application member includes a member for rotating said eccentric cam into contact with said thin walled housing.

* * * * *